US010617268B2

(12) United States Patent
Clay

(10) Patent No.: US 10,617,268 B2
(45) Date of Patent: Apr. 14, 2020

(54) EASY BREEZE-PLUS WIPE

(71) Applicant: Lesley Clay, Las Vegas, NY (US)

(72) Inventor: Lesley Clay, Las Vegas, NY (US)

( * ) Notice: Subject to any disclaimer, the term of this patent is extended or adjusted under 35 U.S.C. 154(b) by 0 days.

(21) Appl. No.: 16/211,196

(22) Filed: Dec. 5, 2018

(65) Prior Publication Data

US 2019/0167049 A1 Jun. 6, 2019

Related U.S. Application Data

(60) Provisional application No. 62/595,481, filed on Dec. 6, 2017.

(51) Int. Cl.
*A47K 13/16* (2006.01)

(52) U.S. Cl.
CPC ..... *A47K 13/16* (2013.01)

(58) Field of Classification Search
USPC ..... 4/245.4
See application file for complete search history.

(56) References Cited

U.S. PATENT DOCUMENTS 4,359,787 A * 11/1982 Shoji ..... A47K 13/16 4/244.3
6,073,274 A * 6/2000 McQueen ..... A47K 13/16 4/245.1
6,711,756 B1 * 3/2004 Mollendor ..... A47K 13/16 4/245.1
6,996,859 B1 * 2/2006 Alonso ..... A47K 13/14 4/244.1

* cited by examiner

*Primary Examiner* — Huyen D Le

(57) ABSTRACT

An improved toilet seat cover and toilet kit for single-use formed having a shape adapted to be used and fit upon a substantial portion of a top surface of a toilet seat in a public restroom.

14 Claims, 5 Drawing Sheets

EASY BREEZE-PLUS WIPE

CROSS-REFERENCE TO RELATED APPLICATION

The present application is related to and claims priority from prior provisional application Ser. No. 62/595,481, filed Dec. 6, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of disposable sanitary covering devices and more specifically relates to an improved toilet seat cover and toilet kit for single-use formed having a shape adapted to be used and fit upon a substantial portion of a top surface of a toilet seat in a public restroom.

2. Description of the Related Art

Consider, for example, that virtually everyone, at one time or another, will have no choice but to use a public restroom at a highway rest-stop, a fast-food restaurant, a convenience store, or any number of similar places. Public restrooms, whether in a stadium, a restaurant, an airport or a highway rest-stop are seldom as clean as they might be. In fact, they're often filthy—and the toilet seats are cold, hard, and crawling with bacteria: not something you'd want to sit on. And while some facilities do provide a dispenser with paper toilet-seat covers, most do not; and the toilet-seat covers are flimsy tissue-paper, more headache than protection. Unfortunately, the seat-covers stick to the skin, and that hanging flap in the middle tends to get contaminated and then touched. Therefore, a need exists for a clean, hygienic toilet seat cover for use in a public restroom, a cover a user may carry with them, use as needed, and then discard.

Various attempts have been made to solve problems found in disposable sanitary covering device art. Among these are found in: U.S. Pat. No. 6,813,784 to Ray Merrill Thompson; U.S. Pat. No. 4,766,617 to Eskild G. Thygesen; and U.S. Pub. No. 2003/0221248 to Darlene Bedley. his prior art is representative of disposable sanitary covering devices for use on a toilet seat.

Ideally, an improved toilet seat cover and toilet kit should be user-friendly and safe in-use and yet would operate reliably and be manufactured at a modest expense. Thus, a need exists for an improved toilet seat cover and toilet kit for single-use formed having a shape adapted to be used and fit upon a substantial portion of a top surface of a toilet seat in a public restroom and to avoid the above-mentioned problems.

BRIEF SUMMARY OF THE INVENTION

In view of the foregoing disadvantages inherent in the known disposable sanitary covering device art, the present invention provides a novel an Improved Toilet Seat Cover and Toilet Kit (Entitled Easy Breeze-Plus Wipe). The general purpose of the present invention, which will be described subsequently in greater detail is to provide a disposable sanitary covering devices and more specifically relates to an improved toilet seat cover and toilet kit for single-use formed having a shape adapted to be used and fit upon a substantial portion of a top surface of a toilet seat in a public restroom.

An improved toilet seat cover comprising: a top layer; a bottom layer; and a middle layer. Wherein the top layer is formed from an impermeable, non-stick material. The bottom layer includes at least one adhesive member attached thereto and adapted to releasably attach the improved toilet seat cover to the toilet seat. Wherein the bottom layer is formed from a sponge material. Wherein the middle layer is connected between the top layer and the bottom layer. Wherein the middle layer is formed from cotton. Wherein the improved toilet seat cover is formed having a shape adapted to be used and fit upon a substantial portion of a top surface of a toilet seat.

A toilet kit is also disclosed comprising: a re-sealable package; a plurality of wipe members; and at least one improved toilet seat cover. The re-sealable package includes two side walls connected together at respective side edges thereof and each having a releasable connector on a top edge portion thereof adapted to be releasably connected to one another and adapted to releasably enclose an interior volume of the re-sealable package. Wherein the two walls are connected along respective interior wall portions thereof forming a top compartment adjacent the top edge portions of the two side walls and a bottom compartment adjacent to the top pocket. Wherein one of said two walls includes a slit along a portion thereof forming two side edges each having a releasable connector thereon adapted to be releasably connected to one another and releasably enclose the bottom compartment. Wherein the plurality of wipe members are adapted to be releasably stored within the bottom compartment.

The present invention holds significant improvements and serves as an Easy Breeze-Plus Wipe. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an Improved Toilet Seat Cover and Toilet Kit (Entitled Easy Breeze-Plus Wipe), constructed and operative according to the teachings of the present invention.

The various embodiments of the present invention will hereinafter be described in conjunction with the appended drawings, wherein like designations denote like elements.

DETAILED DESCRIPTION

Figure 1:
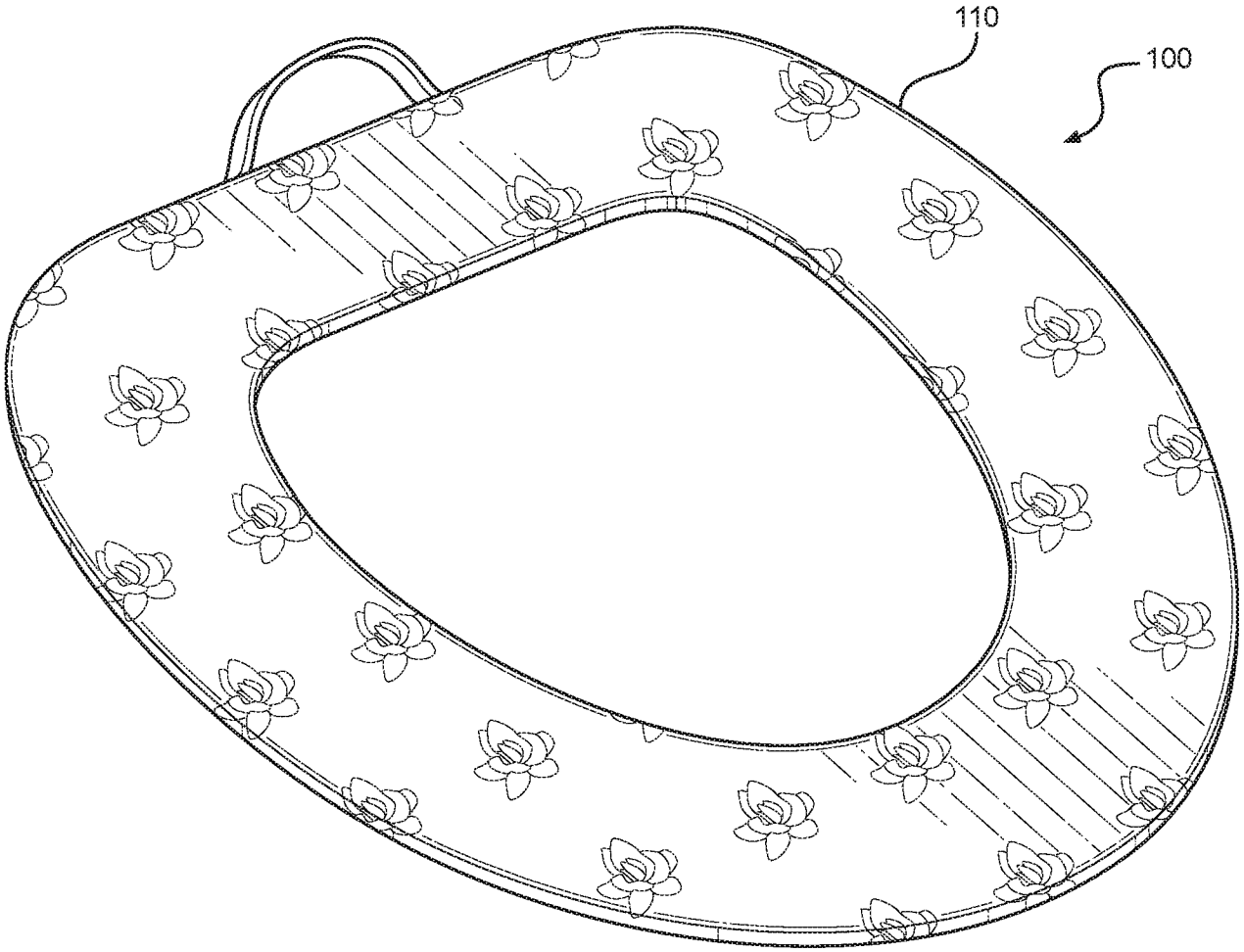
FIG. 1 shows a perspective view illustrating a top layer of an improved Toilet Seat Cover according to an embodiment of the present invention.

As discussed above, embodiments of the present invention relate to a disposable sanitary covering device and more particularly to an Improved Toilet Seat Cover and Toilet Kit (Entitled Easy Breeze-Plus Wipe). The general purpose of the present invention, which will be described subsequently in greater detail is to provide a disposable sanitary covering devices and more specifically relates to an improved toilet seat cover and toilet kit for single-use formed having a shape adapted to be used and fit upon a substantial portion of a top surface of a toilet seat in a public restroom Generally speaking, the Easy Breeze-Plus Wipe comprises a specially designed product line of one-use, disposable toilet-seat covers—soft, impermeable, lined with a spongy material for comfort, adhering to the toilet-seat with a peel-and-stick adhesive—and including its own sanitary wipes.

The Easy Breeze-Plus Wipe would have the oblong, rounded-ring shape and size of the standard toilet-seat, and would be fabricated in an impermeable, non-stick, sanitary paper, with a thin, cushioning undercoating of a spongy material, and a middle layer of 100 percent organic cotton. To be produced in a variety of attractive colors and print patterns—flowers, stars, and animal prints, for example the Easy Breeze seat-cover would be underlain by several strategically-placed strips of peel-and-stick adhesive backing, to ensure a secure attachment to the underlying toilet-seat. Hypo-allergenic and scent-free, the Easy Breeze seat-covers would be packaged in a rectangular, roll-able, flat plastic zip-locked sleeve, with a separate zip-locking compartment for the folding, extra-long, unscented wipes—wipes that will eliminate the need to use the toilet-tissue in public restrooms. Each Easy Breeze-Plus Wipe unit would be packaged separately within the main sleeve, so that the user could take just one set—seat and wipes—into the restroom. After use, simply discard. The Easy Breeze-Plus Wipe would be sold in multiunit packs; and the colors, patterns, and prints on the seat-covers might vary according to the intended market: parents potty-training youngsters women; men; students; travelers; the elderly, etc.

With the plethora of spreadable viruses and diseases in the world such as *Staphylococcus, Norovirus, Shigella, Streptococcus, E. coli*, and even Ebola, the Easy Breeze-Plus Wipe is certainly needed. Putting an end to the use of unsanitary toilet seat covers and liners made of tissue or paper, as well as the toilet tissue rolls in public restrooms, the Easy Breeze-Plus Wipe would provide consumers a sanitary, easy-to-use means of protecting themselves from the often-unsanitary public restroom toilet seat and toilet tissue. Far superior than the seat-covers used in public restrooms today, the Easy Breeze would stick to the seat, not to the user's skin. And, the impermeable Easy Breeze seat-cover would also prevent moisture and germs from reaching the user's skin, and this product would be soft and comfortable, cushioning the hard, cold seats of public-restroom toilets. In short, the Easy Breeze-Plus Wipe would make the use of public restrooms a lot less disagreeable, a lot more sanitary, and a lot safer—and this carry-along personal hygiene product should find a wide and enthusiastic market reception.

Referring to the drawings by numerals of reference there is shown in FIGS. 1-4, perspective views illustrating improved toilet seat cover 100 according to an embodiment of the present invention.

Improved toilet seat cover 100 comprising: top layer 110; bottom layer 300; and middle layer 200. Wherein top layer 110 is formed from an impermeable, non-stick material. Wherein the impermeable, non-stick material of top layer 110 is formed from sanitary paper.

Figure 2:
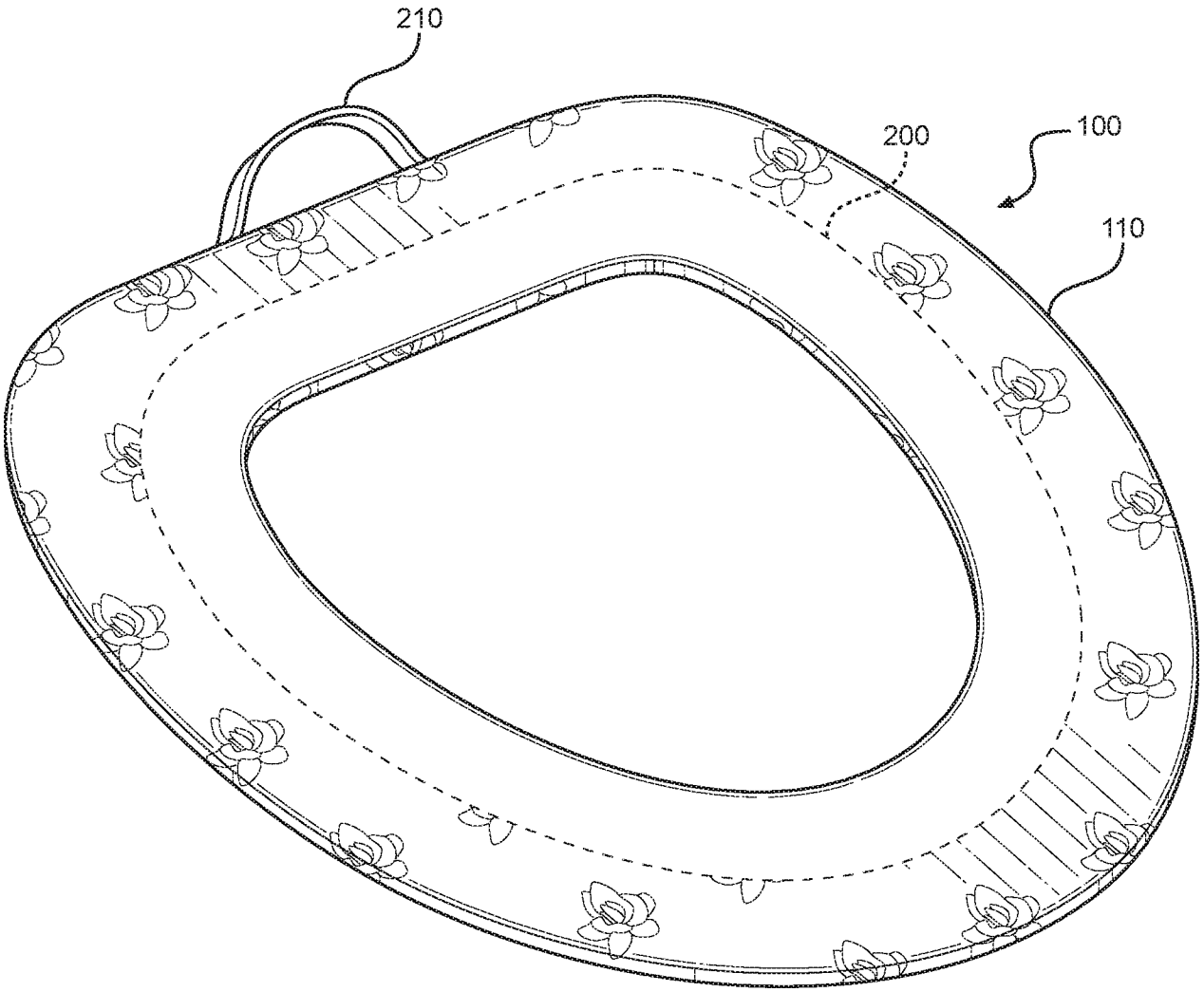
FIG. 2 is a perspective view illustrating a middle layer of the improved Toilet Seat Cover according to an embodiment of the present invention of FIG. 1.
Figure 3:
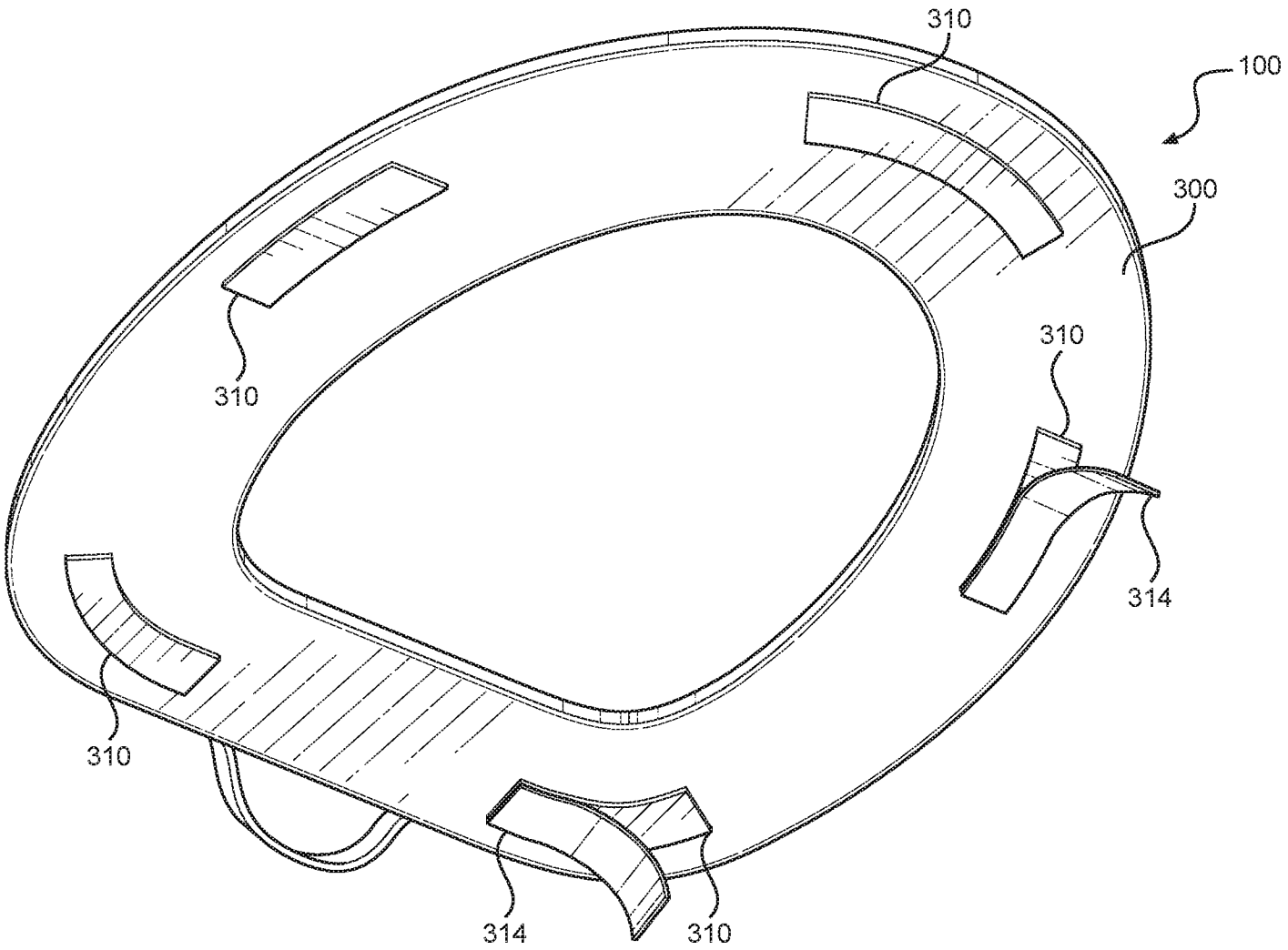
FIG. 3 is a perspective view illustrating a bottom layer of the improved Toilet Seat Cover according to an embodiment of the present invention of FIG. 1.
Figure 4:
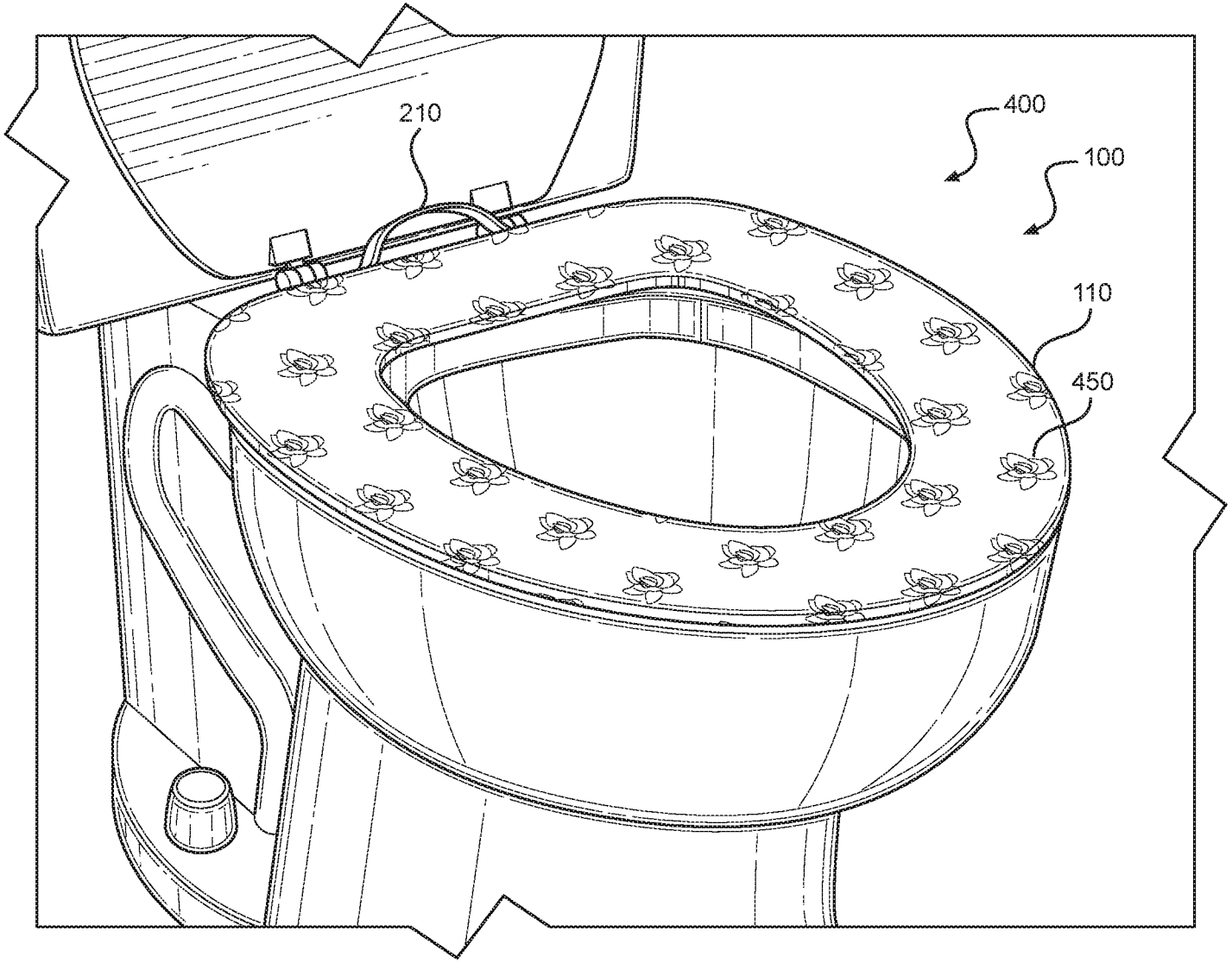
FIG. 4 is a perspective view illustrating the improved Toilet Seat Cover in an in-use condition according to an embodiment of the present invention of FIG. 1.

Bottom layer 300 includes at least one adhesive member 310 attached thereto as shown in FIG. 3 and adapted to releasably attach improved toilet seat cover 100 to toilet seat 450 as shown in in-use condition 400 of FIG. 4. Wherein bottom layer 300 is formed from sponge material. Wherein at least one adhesive member 310 of bottom layer 300 is formed as peel-and-stick adhesive strip 314.

Wherein middle layer 200 is connected between top layer 100 and bottom layer 300 as shown in FIG. 2. Wherein middle layer 200 is formed from cotton. Wherein improved toilet seat cover 100 is formed having a shape adapted to be used and fit upon a substantial portion of a top surface of toilet seat 450 as shown in FIG. 4. Wherein the shape of improved toilet seat cover 100 is formed as an oblong ring shape. Improved toilet seat cover 100 further comprises pull tab 210 attached to a side portion of middle layer 200 and adapted to allow a user to pull and peel improved toilet seat cover 100 of toilet seat 450. Wherein improved toilet seat cover 100 is foldable and adapted to be folded and stored in sealable package 510 as shown in FIG. 5.

Figure 5:
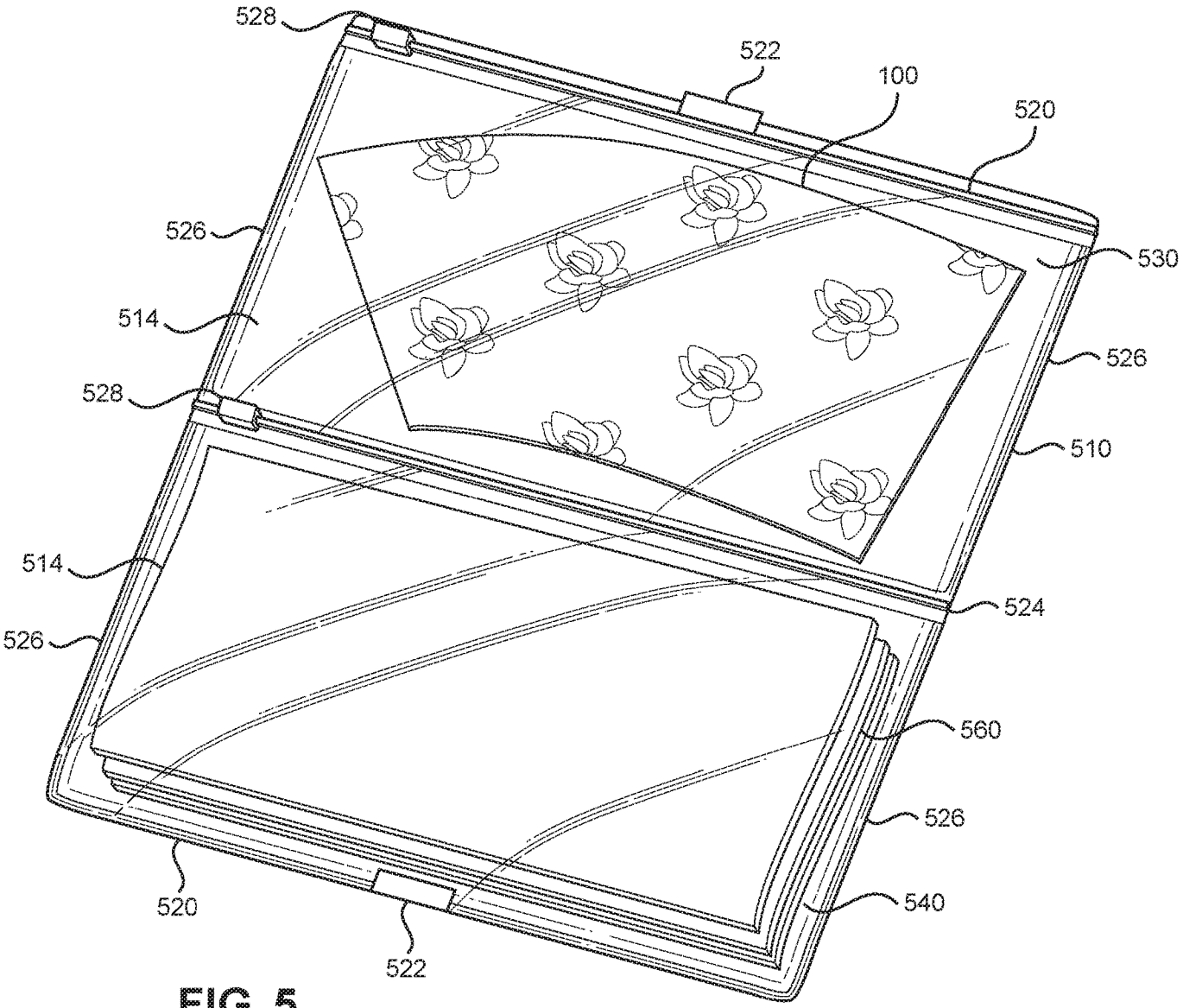
FIG. 5 is a perspective view illustrating a Toilet Kit according to an embodiment of the present invention of FIG. 1.

Referring now to FIG. 5 showing, perspective views illustrating toilet kit 500 according to an embodiment of the present invention.

Toilet kit 500 is also disclosed comprising: re-sealable package 510; plurality of wipe members 560; and at least one improved toilet seat cover 100. Re-sealable package 510 includes two side walls 520 connected together at respective side edges thereof and each having releasable connector 522 on a top edge portion thereof adapted to be releasably connected to one another and adapted to releasably enclose interior volume 514 of re-sealable package 510. Wherein two side walls 520 are connected along respective interior wall portions thereof forming top compartment 530 adjacent the top edge portions of two side walls 520 and bottom compartment 540 adjacent to top compartment 530.

Wherein one of two walls 520 includes slit 524 along a portion thereof forming two side edges 526 each having releasable connector 528 thereon adapted to be releasably connected to one another and releasably enclose bottom compartment 540. Wherein releasable connectors 528 of two side walls 520 are formed as zip-lock connectors. Wherein releasable connectors 528 of two side edges 526 of slit 524 are formed as zip-lock connectors.

Wherein plurality of wipe members 540 are adapted to be releasably stored within bottom compartment 540. Wherein there a plurality of improved toilet seat covers 100 folded and releasably stored within top compartment 530.

Toilet kit 500 has instructions such that functional relationships are detailed in relation to the structure of the invention (such that the invention can be used, maintained, or the like in a preferred manner). Toilet kit 500 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved toilet seat cover comprising:
a top layer;
wherein said top layer is formed from an impermeable, non-stick material; and
a bottom layer including:
at least one adhesive member attached thereto and adapted to releasably attach said improved toilet seat cover to said toilet seat; and
wherein said bottom layer is formed from a sponge material; and
a middle layer;
wherein said middle layer is connected between said top layer and said bottom layer; and
wherein said middle layer is formed from cotton;
wherein said improved toilet seat cover is formed having a shape adapted to be used and fit upon a substantial portion of a top surface of a toilet seat.

2. The improved toilet seat cover of claim 1, wherein said shape of said improved toilet seat cover is formed as an oblong ring shape.

3. The improved toilet seat cover of claim 1, wherein said at least one adhesive member of said bottom layer is formed as a peel-and-stick adhesive strip.

4. The improved toilet seat cover of claim 1, further comprising a pull tab attached to a side portion of said middle layer and adapted to allow a user to pull and peel said improved toilet seat cover of said toilet seat.

5. The improved toilet seat cover of claim 1, wherein said impermeable, non-stick material of said top layer is formed from sanitary paper.

6. The improved toilet seat cover of claim 1, wherein said improved toilet seat cover is foldable and adapted to be folded and stored in a sealable package.

7. A toilet kit comprising:
a re-sealable package including:
two side walls connected together at respective side edges thereof and each having a releasable connector on a top edge portion thereof adapted to be releasably connected to one another and adapted to releasably enclose an interior volume of said re-sealable package;
wherein said two walls are connected along respective interior wall portions thereof forming a top compartment adjacent said top edge portions of said two side walls and a bottom compartment adjacent to said top pocket;
wherein one of said two walls includes a slit along a portion thereof forming two side edges each having a releasable connector thereon adapted to be releasably connected to one another and releasably enclose said bottom compartment;
a plurality of wipe members;
wherein said plurality of wipe members are adapted to be releasably stored within said bottom compartment; and
at least one improved toilet seat cover, each comprising:
a top layer;
wherein said top layer is formed from an impermeable, non-stick material; and
a bottom layer including:
at least one adhesive member attached thereto and adapted to releasably attach said improved toilet seat cover to said toilet seat; and
wherein said bottom layer is formed from a sponge material; and
a middle layer;
wherein said middle layer is connected between said top layer and said bottom layer; and
wherein said middle layer is formed from cotton;
wherein said at least one improved toilet seat cover is formed having a shape adapted to be used and fit upon a substantial portion of a top surface of a toilet seat; and
wherein said at least one improved toilet seat cover is folded and adapted to be releasably stored within said top compartment.

8. The toilet kit of claim 7, wherein said shape of said at least one improved toilet seat cover is formed having an oblong ring shape.

9. The toilet kit of claim 7, wherein said at least one adhesive member of said bottom layer of said at least one improved toilet seat cover is formed as a peel-and-stick adhesive strip.

10. The toilet kit of claim 7, wherein said of said at least one improved toilet seat cover further comprises a pull tab attached to a side portion of said middle layer and adapted to allow a user to pull and peel said improved toilet seat cover of said toilet seat.

11. The toilet kit of claim 7, wherein said impermeable, non-stick material of said top layer of said at least one improved toilet seat cover is formed from sanitary paper.

12. The toilet kit of claim 7, wherein said releasable connectors of said two walls are formed as zip-lock connectors.

13. The toilet kit of claim 7, wherein said releasable connectors of said two side edges of said slit are formed as zip-lock connectors.

14. The toilet kit of claim 7, wherein there a plurality of improved toilet seat covers folded and releasably stored within said top compartment.

* * * * *